US008280008B2

(12) United States Patent
Reis et al.

(10) Patent No.: US 8,280,008 B2
(45) Date of Patent: Oct. 2, 2012

(54) X-RAY ROTATING ANODE PLATE, AND METHOD FOR THE PRODUCTION THEREOF

(76) Inventors: Hans-Henning Reis, Bad Klosterlausnitz (DE); Dieter Melzer, Freiberg/OT Zug (DE)

( * ) Notice: Subject to any disclaimer, the term of this patent is extended or adjusted under 35 U.S.C. 154(b) by 279 days.

(21) Appl. No.: 12/681,055

(22) PCT Filed: Oct. 1, 2008

(86) PCT No.: PCT/DE2008/001629

§ 371 (c)(1),
(2), (4) Date: Jul. 13, 2010

(87) PCT Pub. No.: WO2009/043344

PCT Pub. Date: Apr. 9, 2009

(65) Prior Publication Data

US 2010/0284520 A1 Nov. 11, 2010

(30) Foreign Application Priority Data

Oct. 2, 2007 (DE) ..... 10 2007 047 544
Apr. 28, 2008 (DE) ..... 10 2008 021 551

(51) Int. Cl.
*H01J 35/10* (2006.01)

(52) U.S. Cl. ..... 378/144

(58) Field of Classification Search ..... 378/119, 378/115, 144, 125; 419/66; 156/62.2; 977/949
See application file for complete search history.

(56) References Cited

U.S. PATENT DOCUMENTS 4,132,916 A 1/1979 Hueschen et al.
4,516,255 A 5/1985 Petter et al.
5,204,890 A 4/1993 Anmo et al.
5,866,434 A 2/1999 Massey et al.
5,943,389 A 8/1999 Lee (Continued)

FOREIGN PATENT DOCUMENTS

DE 28 05 154 11/1978

(Continued)

OTHER PUBLICATIONS

Qin et al.; "High temperature electrical and thermal properties of the bulk carbon nanotube prepared by SPS"; Materials Science and Engineering A: Structural Materials: Properties, Microstructure & Processing, Lausanne, CH, vol. 420, No. 1-2, Mar. 31, 2006, pp. 208-211, XP005900617.

(Continued)

*Primary Examiner* — Irakli Kiknadze
(74) *Attorney, Agent, or Firm* — Jordan and Hamburg LLP

(57) ABSTRACT

Described is an X-ray rotating anode plate having a base and X-ray active layer having the described acceptable properties and a method for producing same. The base comprises carbon nanoparticles in quasi-homogeneous spatial distribution. Carbon nanoparticles can be selected from among carbon nanotubes, nano-graphite powder particles having a substantially spherical shape, and mixtures thereof. The inclusion of described additives improves the stability and heat conductivity of the base. With the described method, the starting materials for the base and X-ray active layer, and other optional materials which may form functional layer are compressed to a preselected shape in a pressing mold with simultaneous application of pressure, elevated temperature and varied electric currents, compressing the shape to a final density exhibiting high-strength diffusion bonds between these starting materials. The described X-ray rotating anode plate can be used, for example, in high-performance X-ray tubes for X-ray computer tomography.

37 Claims, 4 Drawing Sheets

U.S. PATENT DOCUMENTS

| | | | | |
|---|---|---|---|---|
| 6,980,627 | B2 * | 12/2005 | Qiu et al. | 378/122 |
| 7,194,066 | B2 | 3/2007 | Tiearney, Jr. et al. | |
| 7,250,208 | B2 | 7/2007 | Lenz | |
| 7,359,484 | B2 * | 4/2008 | Qiu et al. | 378/122 |
| 7,406,156 | B2 | 7/2008 | Lenz | |

FOREIGN PATENT DOCUMENTS

| | | |
|---|---|---|
| DE | 33 03 529 | 9/1983 |
| DE | 32 38 352 | 4/1984 |
| DE | 691 21 504 | 2/1997 |
| DE | 196 50 061 | 6/1997 |
| DE | 103 01 069 | 7/2004 |
| DE | 695 32 044 | 7/2004 |
| DE | 10 2005 015 920 | 10/2005 |
| DE | 10 2005 039 187 | 2/2007 |
| DE | 10 2005 039 188 | 2/2007 |
| JP | 2005-166565 | 6/2005 |
| JP | 2006-086001 | 3/2006 |
| WO | WO-99/45564 | 9/1999 |
| WO | WO-03/043046 | 5/2003 |

OTHER PUBLICATIONS

Peigney A et al.,; "Aligned carbon nanotubes in ceramic-matrix nanocomposites prepared by high-temperature extrusion"; Chemical Physics Letters Elsevier Netherlands, vol. 352, No. 1-2, Jan. 24, 2002, p. 10, XP002514940.

* cited by examiner

X-RAY ROTATING ANODE PLATE, AND METHOD FOR THE PRODUCTION THEREOF

BACKGROUND OF THE INVENTION

The invention relates to an X-ray rotating anode plate and to a method for the production thereof, wherein the X-ray rotating anode plate comprises a base. The base, which carries a layer applied thereon, or a body inserted therein, is made of X-ray active material having a focal path, such as a tungsten-rhenium alloy comprising 5 to 10 mass % of rhenium, and provides the overall design with stability and ability to dissipate heat energy developed during the energetic conversion of electron radiation into X-ray radiation. Important factors for the material of the base in terms of dissipating thermal energy are characteristic properties such as heat capacity, heat conductivity, or heat transfer, and adapting the thermal expansions between, or of, the X-ray active material and the base.

The demands in terms of thermal and mechanical resilience for X-ray rotating anode plates are steadily on the rise. Presently, temperatures of more than 3000° C. may develop at the electronic focal point in the case of high-performance X-ray tubes. In order to improve energy distribution, the plate is rotated at 9,000 rpm. Rotational speeds of 15,000 rpm and higher are planned for the future. For the same reasons, the diameters of rotating anode plates are presently as large as 200 mm, with 300 mm planned for the future. The stability of the base material must be able to meet these requirements.

X-ray rotating anode plates having a base body made of a molybdenum alloy, such as molybdenum with additives of titanium, zirconium, and carbon ("TZM"), have been known for quite some time, for example, from the disclosure of DE 33 03 529 A1. At high rotational speeds of the rotating anode plate, problems are caused by the high density of 10.2 g/cm$^3$ of the primary constituent in the base, which is molybdenum. Such X-ray rotating anode plates can achieve a mass of more than 5 kg. Specifically in the case of computer tomography scanners, the rotation of the X-ray rotating anode plate in the X-ray tube is combined with the rotation and translation of the entire system in which the X-ray tube is located, thereby producing uncontrolled centrifugal forces in several directions. In addition, the immense material costs for the metal designs described above should not be underestimated.

At any given heat capacity, the density, and therefore the mass, of graphite is lower, which is why joined X-ray rotating anode plates, which have a base made of graphite, are known (DE 32 38 352 A1). The stability of graphite at high rotational speeds is entirely insufficient due to the layered microstructure thereof. This is also true of main bodies made of graphite, which have been provided with an X-ray active layer made of tungsten-rhenium by way of vacuum plasma spraying.

Because the stability of the base, based on both molybdenum and graphite, is limited, under the mechanical and thermal loads described above there is a real risk of damage or destruction.

Also, main bodies for these applications that are made of fiber-reinforced graphite are known. Preferably, carbon fibers are used, wherein, for example, adjustment of the thermal expansion coefficient of the base to that of the X-ray active material that is applied (DE 103 01 069 A1), or high thermal expansion in the radial direction, associated with high thermal conductivity in the axial direction (DE 196 50 061 A 1), are achieved by way of the spatial arrangement of the fibers or fiber meshwork. While the carbon fibers mentioned above have good thermal conductivity in the fiber direction, as well as excellent stability, these properties are significantly inferior, by several orders of magnitude, in the direction perpendicular thereto. The last-mentioned technical solution attempted to limit this anisotropy by three-dimensionally interweaving the carbon fibers. However, the material remains anisotropic in the double-digit micrometer range.

A novel carbon-based material consists of so-called carbon nanotubes (CNT), the earliest technical development of which is described in the "Background of the Invention" section European patent DE 695 32 044 T2, which patent is directed to chemically effective functional layers on carbon nanotubes and hence to an entirely different subject matter than that of the present invention.

With conventional graphite, carbon atoms are arranged extending in a hexagonal configuration in individual planes. With carbon nanotubes, such hexagonal arrangements are closed in a tube-like manner, resulting in outstanding mechanical, electrical, and thermal properties. As the prefix "nano" indicates, the diameters of these carbon nanotubes are in the nanometer range. Depending on the source, this means 0.4 nm to 50 nm or 100 nm.

Depending on the manufacturer's information, the bulk density of carbon nanotubes is around 0.15 g/cm$^3$, the material density is given as 1.3 g/cm$^3$ to 1.4 g/cm$^3$, which is clearly below that of graphite. A theoretical value of 45 GPa is given for stability, which would be approximately 20 times that of steel and 200 times that of TZM, the base material mentioned above. The theoretical thermal conductivity is 6000 W/mK, which is double that of diamond materials, and is greater than that of metallic heat conductors by at least one order of magnitude. Furthermore, the use of carbon nanotubes in connection with X-ray tubes is known. These are usually carbon nanotubes in a strictly parallel orientation.

For example, a cathode is known for an X-ray tube, wherein, in order to achieve a cathode surface having small dimensions, the carbon nanotubes are disposed on a plate having negative potential and serve as emitters that emit electrons to an opposing target made of copper (Japanese abstract 2005166565).

In another cathode for X-ray tubes, the nanotubes are disposed behind a control grid and serve to implement a cathode having an adjustable emission surface (Japanese abstract 2006086001).

In addition, a technical solution has been disclosed in which a "forest" or a "floccus" of vertical, parallel carbon fibers having good heat conductivity is arranged on an X-ray active layer (that is, on the electron impingement surface) of X-ray anodes, but carbon fibers employed in this solution are not expressly carbon nanotubes (U.S. Pat. No. 5,943,389). The purpose of this arrangement is to dissipate heat through the carbon fibers, in addition to the heat dissipation through the base.

Furthermore, an X-ray anode is known, on the anode impingement surface of which, carbon nanotubes, preferably in the form of a woven fabric, are disposed in order to suppress the formation of secondary electrons and the development of a plasma and/or the release of neutral gases (WO 03/043036 A1).

Main bodies for X-ray rotating anode are also known in which carbon fibers, preferably carbon nanotubes made of copper (DE 102005039187) or titanium (DE 102005039188), are embedded in order to improve heat dissipation. Copper is disadvantageous in that the melting point thereof is too low for high heat dissipation performance; titanium and copper both have the disadvantage of tending to form carbides at the temperatures at which the carbon is used.

In addition, carbon nanoparticles having a graphite structure, a substantially spherical shape and an average particle size of 55 nm, for example, have recently been disclosed (company publication from Auer-Remy GmbH, Hamburg, Del., "Nanopowders", item "C-1249YD 7440-44-0"). In addition to the advantageous properties of the carbon nanoparticles in the present context, from a process engineering point of view, when processing the raw materials for shaping the base, achieving a spatial distribution that ensures substantially isotropic properties in the base is naturally less difficult with spherical particles, having the same dimensions in all axial directions, than with carbon nanotubes having an axial extension.

Several of the carbides and nitrides which serve to increase stability in the present invention have already been used for X-ray rotating anodes, but with an entirely different function, and without information as to particle size.

In addition to other compounds, carbides and nitrides of tantalum, niobium, molybdenum, and tungsten have been used for erosion-resistant, liquid metal-lubricated tribological pairings between the rotating anode shaft and the bearing thereof (DE 69 121 504 T2).

In addition to other compounds, tantalum carbide has been proposed for coating the back of the rotating anode plate in order to improve heat emission (DE 2 805 154).

Finally, in addition to other compounds, molybdenum carbide and tungsten carbide are known in arrangements having a plurality of layers for adjusting the thermal expansion coefficient between the X-ray active layer and the base (DE 10 2005 015 920).

SUMMARY OF THE INVENTION

It is an object of the invention to create an X-ray rotating anode plate having a base, which meets the requirements mentioned at the outset with respect to the temperature of the focal point and the desired rotational speeds of X-ray rotating anode plates by way of low mass, suitable heat conductivity and sufficient high-temperature stability, with the same or possibly lower material costs for the base, and which is able to overcome the deficiencies of the state of the art. It is a further object of the invention to create an efficient production method for such an X-ray rotating anode plate, which comprises the base having the X-ray active layer, and includes necessary or advantageous intermediate layers between the two.

The production of the base according to the invention, comprising carbon nanoparticles, or a base made from high-performance graphite and/or fiber graphite materials containing such carbon nanoparticles, is possible according to conventional technologies, or by using the latest powder technologies, but care must be taken so that the structures of the carbon nanoparticles, and in particular those of the carbon nanotubes, are not destroyed.

A basic requirement for achieving the desired effects with respect to high-temperature stability, heat conductivity, and thermal expansion is the quasi-homogeneous distribution of the carbon nanoparticles in the component, in order to achieve a base that is substantially isotropic in the submacroscopic range, in terms of stability, heat conductivity, and thermal expansion, which is to say to achieve a degree of anisotropy degree of, for example, <1.2 (ratio of the maximum value to the minimum value when measured in the three spatial dimensions). It is particularly favorable that the individual carbon nanotubes have a slightly angled shape.

According to the invention, the macrostability of the base material can be increased by adding high-stability compounds, such as oxides, nitrides, borides, carbides, silicides of tantalum, niobium, chromium, silicon, molybdenum, hafnium, boron and/or tungsten, or mixtures thereof, and fibers made from these materials. Mixtures of these compounds are also possible. In view of the stability of the bond between the base and the X-ray active layer, the proportion of these substances can be varied in the axial direction, and it is also advantageous that the proportion of optionally present graphite or graphite fibers decreases toward the X-ray active layer in favor of the proportion of carbon nanoparticles and stability-increasing substances.

The base can be provided with the X-ray active layer using conventional coating methods, wherein known diffusion barrier layers made of rhenium, molybdenum, tantalum, niobium, zirconium, titanium, or compounds and combinations of these metals can be added, in order to control harmful carbon diffusion, and in an advantageous embodiment of the invention a bonding layer can further be provided, such as by introducing rhenium or rhenium compounds, or carbides, into the surface region of the base.

It may also be advantageous to introduce a compensating layer, preferably made of molybdenum, or a molybdenum alloy, between the diffusion barrier layer and the X-ray active layer. This is, for example, used to compensate for differences between these two layers in terms of thermal expansion and/or ductility.

A technical solution through joining a conventional metal X-ray rotating anode plate with the base, whereby the improved stability of the base according to the invention, allows the plate to be designed considerably thinner than in the prior art, which helps reduce mass and cost. It should be noted that, in principle, the reduced mass is advantageous not only with respect to the material costs, but also because of lower centrifugal forces.

When using carbon nanotubes, a certain level of nanoporosity is normally to be expected, and thus processing in the negative pressure range, with a residual atmosphere of protective gases, or also the use of capped carbon nanotubes, is advantageous.

The advantageous economic effects of the invention as a result of the innovative materials that are used will be explained below in comparison with a base made of TZM as the state of the art. Carbon nanotubes are produced industrially at pilot scales. The price level is approximately 150 EUR/kg, and thus compared to a metallic base according to the prior art, and thus both a lower price per kilo and a lower density are of interest. For a 200 mm X-ray rotating anode plate, the approximate numbers are as follows:

TZM: 5.0 kg, corresponding to 1000 EUR material cost

Carbon nanotubes: 0.7 kg, corresponding to 100 EUR material cost

The advantageous effects of the invention as a result of the production method according to the invention are the savings of expensive coating or customization methods and the investments required to do so, the minimization of material use, and an increase in stability of the overall component.

BRIEF DESCRIPTION OF THE DRAWINGS

The invention will be explained in more detail hereinafter based on six exemplary embodiments.

Shown are.

DETAILED DESCRIPTION OF THE INVENTION

Embodiment 1

Figure 1:
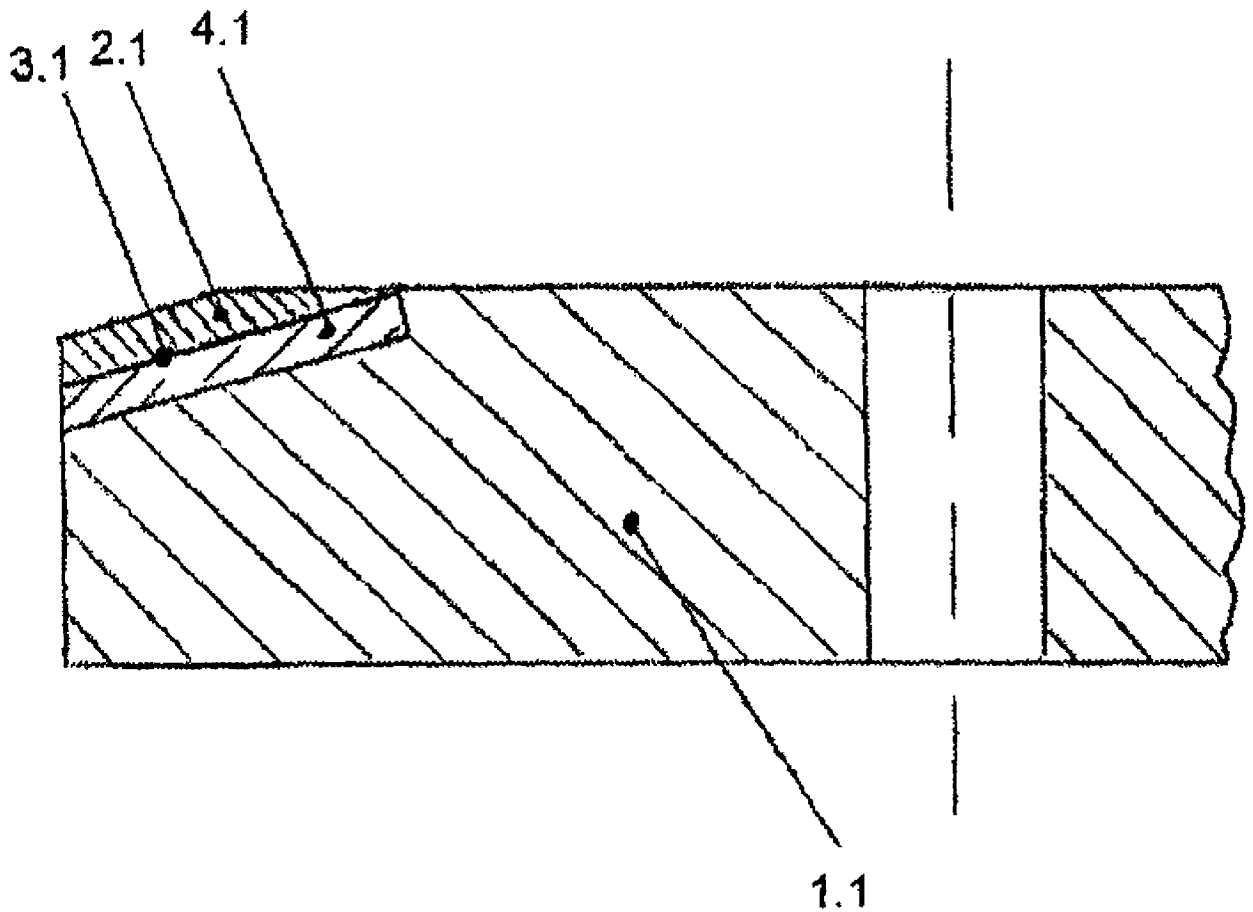
FIG. 1: an X-ray rotating anode plate according to embodiment 1.

The X-ray rotating anode plate illustrated in a sectional view in FIG. 1 comprises a base 1.1 comprising 60 mass % carbon nanotubes and 40 mass % nano graphite powder particles, onto which a known diffusion barrier layer 3.1 comprising tungsten-rhenium-tantalum, which also serves as a bonding layer 4.1, and the X-ray active layer 2.1 are applied. The diameter of the X-ray rotating anode plate is 120 mm, the thickness thereof is 15 mm.

The base 1.1 is produced using the conventional methods of powder metallurgy and graphite processing, by mixing the powders, and pressing and heat treating them, if necessary by employing a hot pressing method, in near net shape dimension, and by finishing the body by way of machining.

Conventional high-purity uncapped carbon nanotubes and fine-grained nano graphite powder particles are used. The nanotubes differ little among each other in terms of length and diameter, and preferably are shorter than 10 nm on average. If possible, the longitudinal axis thereof should deviate from a straight line.

After vacuum plasma spraying, a diffusion bond is formed between the base 1.1 and the layers by way of suitable heat treatment, and the X-ray rotating anode plate is finished using conventional methods.

Embodiment 2

Figure 2:
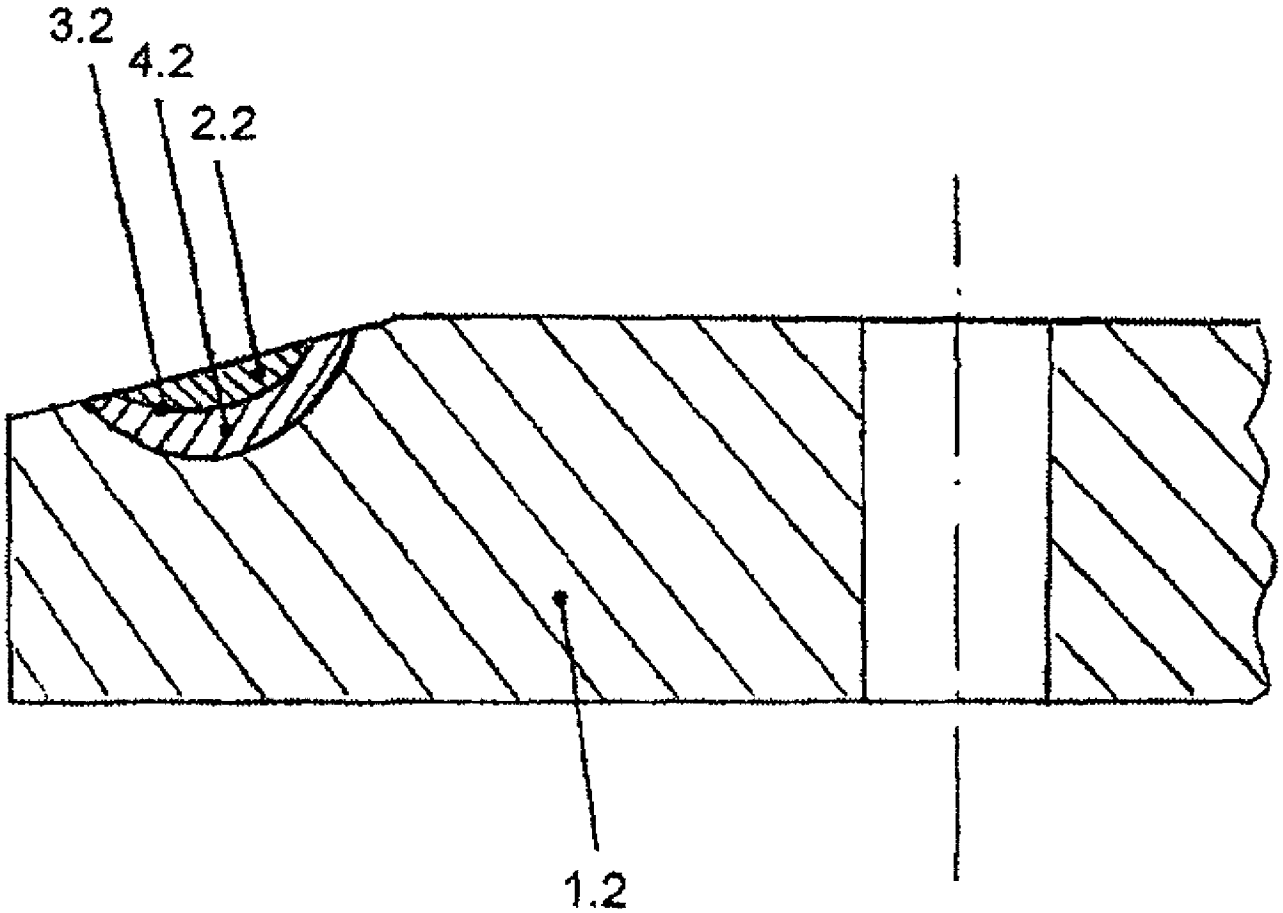
FIG. 2: an X-ray rotating anode plate according to embodiments 2 and 3.

Embodiment 2 differs from embodiment 1, in that the X-ray rotating anode plate shown in a sectional view in FIG. 2 comprises a base 1.2, which is made of commercially available carbon nanotubes having an added 20% by volume of tungsten carbide.

A depression in keeping with the orientation of the isotherms in the operating state according to patent application 10 2005 000 784 A1 is introduced into the base 1.2, the depression being filled by the X-ray active layer 2.2 made of tungsten with 5 mass % rhenium. The diffusion barrier layer 3.2, which is also the bonding layer 4.2, is made of tantalum in this example, and has a thickness of 0.2 mm; it is adapted to the shape of the depression as with the X-ray active layer 2.2, the function thereof corresponds to the layers 2.1, 3.1 or 4.1 of embodiment 1. The same applies to the geometric dimensions of the X-ray rotating anode plate.

The entire component comprising all the layers mentioned above is produced after placing it in a suitable mold in one operation by hot pressing using pulsed currents at 2400° C., at a pressure of 40 MPa, in a residual gas atmosphere comprising argon and having a minor hydrogen component, at residual pressure of approximately 2 Pa.

Finishing is carried out according to the conventional methods.

Embodiment 3

The quality of the X-ray rotating anode plate produced in accordance with embodiment 2 is improved as follows. The layer 2.2 is adjusted to a tungsten composition having 1 mass % rhenium. After prefabricating the component, the plate bevel is finished smoothly and an X-ray active layer having a tungsten composition with 5 mass % rhenium is applied at a thickness of 200 μm by way of vacuum plasma spraying.

Finishing is carried out according to the conventional methods.

Embodiment 4

Figure 3:
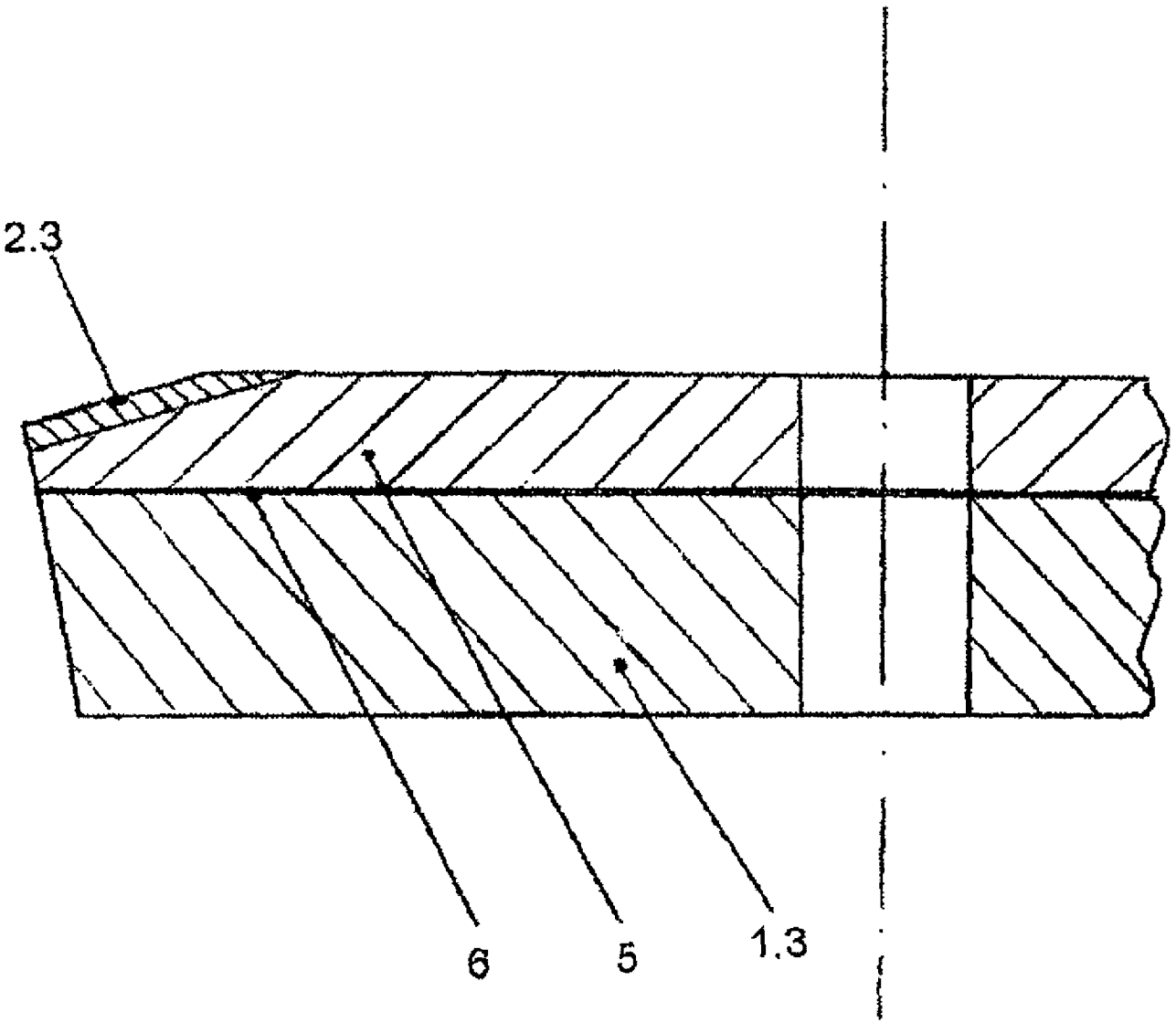
FIG. 3: an X-ray rotating anode plate according to embodiment 4.

The X-ray rotating anode plate shown in a sectional view in FIG. 3 represents a transition, in terms of the technology and the production process, between a conventional X-ray rotating anode plate made of metal and the solution according to the invention, wherein, as a matter of course, all of the essential characteristics of the invention have been implemented.

The base 1.3, which is beveled toward the axis at the outer edge, corresponds, in terms of the technology and the composition, to the base 1.1 of embodiment 1. A finished metal body 5 made of a molybdenum-TZM alloy having an X-ray active layer 2.3 is bonded to the base 1.3 by way of diffusion welding at the surface 6.

The excellent stability properties of the base 1.3 comprising carbon nanotubes allow the metal body 5 to be designed considerably thinner and lighter than in the X-ray rotating anode plates made of metal having a graphite base according to the prior art, despite the intended high rotational speeds and operating temperatures. As in embodiments 1 and 2, the diameter of the X-ray rotating anode plate is also 120 mm; but unlike the preceding embodiments, the overall thickness is 16 mm, which is to say 6 mm of metal body 5 plus 10 mm of base 1.3.

Embodiment 5

Figure 4:
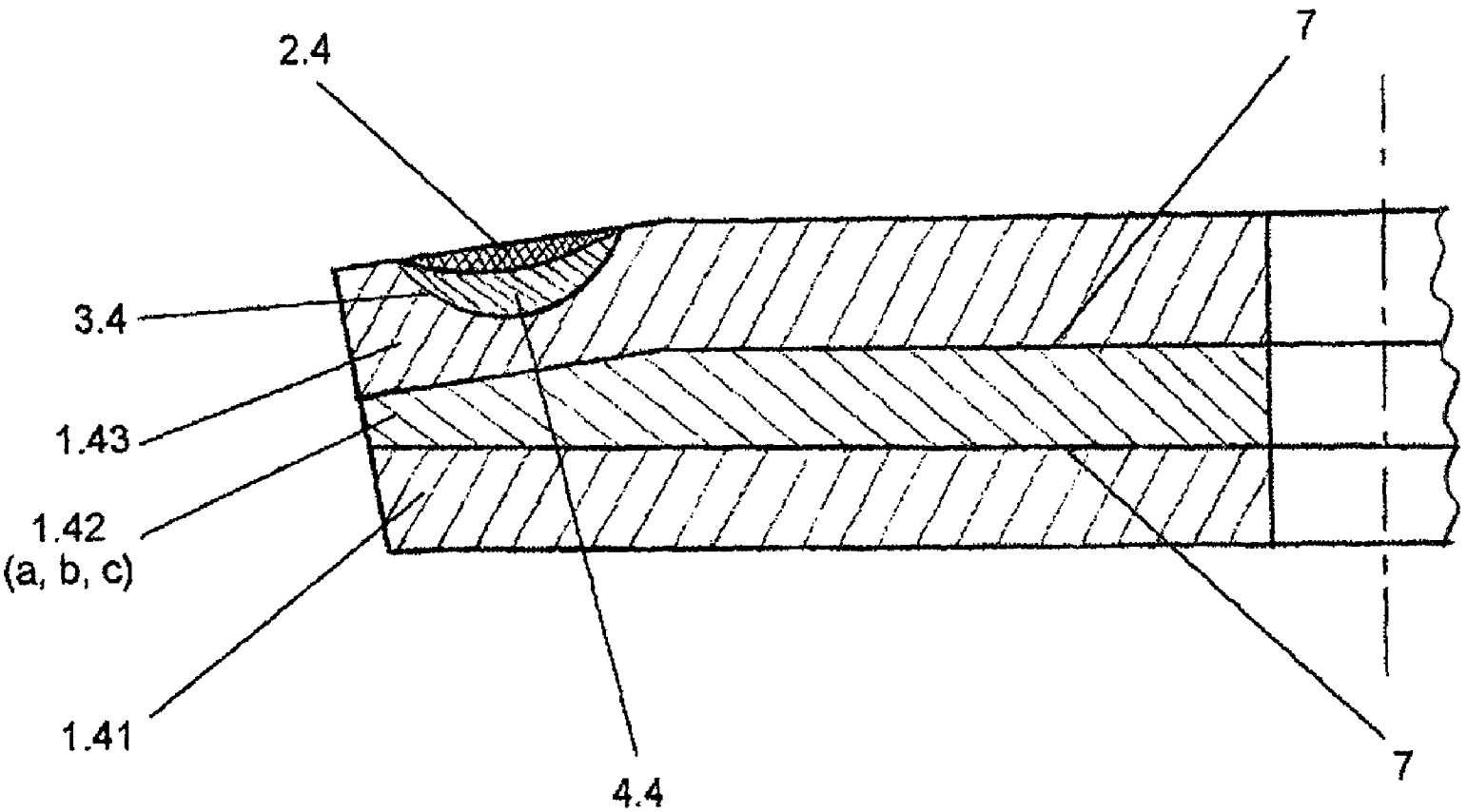
FIG. 4: an X-ray rotating anode plate according to embodiment 5.

FIG. 4 shows a layered base of an X-ray rotating anode plate, in which the cross-sectional shape of the bonding layer 4.4 and the X-ray active layer 2.4, once again follows an isotherm of the temperature distribution in the area surrounding the X-ray active layer in the operational state, as in the remaining embodiments 2 and 3

From the bottom to the top, which is to say toward the X-ray active layer, the layers of the base have the following composition:

Bottom layer 1.41: single-walled carbon nanotubes and on average 30% by volume of silicon carbide, the content in this layer preferably increasing from top to bottom.

For the intermediate layer 1.42, three alternative variants are provided:

1.42*a*: 100 mass % nano-graphite powder particles,

1.42*b*: 50 mass % nano-graphite powder particles and 50 mass % single-walled carbon nanotubes.

1.42*c*: solid, preformed plate made of graphite suitable for X-rays, which contributes to improving the heat conductivity of the base 1.

Top layer 1.43: single-walled carbon nanotubes comprising on average 20% by volume tungsten carbide, the content in this layer preferably increasing from top to bottom.

Base bonding layers comprising molybdenum carbide and measuring 80 μm in thickness are provided, between each of these layers 1.41, 1.42, and 1.43.

In a bevel of 10° with respect to the horizontal line in the upper layer 1.43, a depression in keeping with the orientation of an isotherm is incorporated in the region of the focal path. Provided there, in the bottom-to-top order, are: a diffusion barrier layer 3.4 having a thickness of 100 μm and comprising 40% by volume tantalum carbide and 60% by volume niobium carbide. A bonding layer 4.4 made of molybdenum comprising 12 mass % tungsten is applied thereon, down to about half the depth of the depression, and finally the X-ray active layer 2.4, which is made of tungsten having 6 mass % rhenium, is provided so as to fill the depression up to the level of the bevel.

The typical dimensions of such an X-ray rotating anode plate are, for example, a diameter of 120 mm, with layers 1.41 and 1.42 each being 6 mm thick, and layer 1.43 being 8 mm thick. The width of the depression comprising the layers 3.4 and 4.4 and of the X-ray active layer 2.4 is 35 mm, and the maximum depth thereof is 6 mm, measured from the bevel surface.

The invention claimed is:

1. An X-ray rotating anode plate comprising a base and a X-ray active layer, the base being comprised of carbon nanoparticles in a quasi-homogeneous spatial distribution, whereby the base is provided with substantially isotropic properties in the submacroscopic range.

2. The X-ray rotating anode plate according to claim 1, wherein the carbon nanoparticles are comprised of carbon nanotubes.

3. An X-ray rotating anode plate according to claim 2, wherein the individual carbon nanotubes are provided with an axial direction that deviates from a straight line.

4. The X-ray rotating anode plate according to claim 3, wherein the axial direction of the individual carbon nanotubes has an angled course.

5. The X-ray rotating anode plate according to claim 3, wherein the axial direction of the individual carbon nanotubes has a course in the form of a helical curve.

6. The X-ray rotating anode plate according to claim 2, wherein the carbon nanotubes are multiple-wall carbon nanotubes.

7. The X-ray rotating anode plate according to claim 2, wherein the carbon nanotubes are provided with lengths and diameters that do not differ by more than a factor of 10.

8. The X-ray rotating anode plate according to claim 7, wherein the lengths and diameters of the carbon nanotubes do not differ by more than a factor of 3.

9. The X-ray rotating anode plate according to claim 2, wherein the carbon nanotubes are provided with ends at which ends the carbon nanotubes are closed by a cap.

10. The X-ray rotating anode plate according to claim 9, wherein the carbon nanotubes have a spherical shape.

11. The X-ray rotating anode plate according to claim 1, wherein the carbon nanoparticles are comprised of nano-graphite powder particles having a substantially spherical shape.

12. The X-ray rotating anode plate according to claim 1, wherein the carbon nanoparticles are comprised of carbon nanotubes and nano-graphite powder particles having a substantially spherical shape.

13. The X-ray rotating anode plate according to claim 1, wherein the base comprises a graphite suitable for X-rays.

14. The X-ray rotating anode plate according to claim 1, wherein the base comprises graphite fibers.

15. The X-ray rotating anode plate according to claim 1, wherein the base comprises carbon nanoparticles in an amount of 10 wt % to 90 wt %.

16. The X-ray rotating anode plate according to claim 15, wherein the base comprises carbon nanoparticles in an amount of 50 wt % to 70 wt %.

17. An X-ray rotating anode plate according to claim 1, wherein the proportion of carbon nanoparticles in the axial direction varies incrementally.

18. The X-ray rotating anode plate according to claim 17, wherein the base includes multiple layers including an intermediate layer that is at least predominantly comprised of graphite suitable for X-rays.

19. The X-ray rotating anode plate according to claim 18, wherein the intermediate layer is located between layers of the base that include carbon nanoparticles.

20. The X-ray rotating anode plate according claim 1, wherein the base is further comprised of an additive selected from oxides, nitrides, borides, carbides, silicides of tantalum, niobium, chromium, silicon, molybdenum, hafnium, boron and/or tungsten, or mixtures thereof, the additive being included in a stability-increasing and a heat conductivity improving amount.

21. The X-ray rotating anode plate according to claim 20, wherein the additive is present in fiber form.

22. The X-ray rotating anode plate according to claim 20, wherein the additive is present as particles having sizes in the nanometer range.

23. The X-ray rotating anode plate according to claim 22, wherein the average particle size of the additive particles is 40 nm to 200 nm.

24. The X-ray rotating anode plate according to claim 20, wherein the additive comprises 4% to 80% of the volume of the base.

25. The X-ray rotating anode plate according to claim 24, wherein the additive comprises 20% to 40% of the volume of the base.

26. The X-ray rotating anode plate according to claims 20, wherein the base includes an intermediate layer at least predominantly comprised of graphite suitable for X-rays and the proportion of the additive varies steadily or in layers in the axial direction.

27. The X-ray rotating anode plate according to claim 1, wherein a diffusion barrier layer comprising rhenium, molybdenum, tantalum, niobium, chromium, tungsten, zirconium, or combinations or compounds thereof, is disposed between the base and the X-ray active layer, whereby the diffusion barrier layer functions as a bonding layer and as a compensating layer.

28. The X-ray rotating anode plate according to claim 27, wherein the diffusion barrier layer extends beyond the X-ray active layer.

29. The X-ray rotating anode plate according to claim 28, wherein the X-ray active layer fills a groove having a cross-sectional shape corresponding to an isotherm representing the temperature distribution in an area surrounding the X-ray active region when the X-ray rotating anode plate is in an operational state.

30. The X-ray rotating anode plate according to claim 29, wherein the composition of the layers varies incrementally in the axial direction.

31. The X-ray rotating anode plate according to claim 29, wherein the composition of the layers varies incrementally in the axial direction from layer to layer.

32. The X-ray rotating anode plate according to claim 1, wherein the X-ray rotating anode plate is further comprised of a metal body carrying the X-ray active layer, the metal body being joined to the base.

33. A method for producing an X-ray rotating anode plate according to claims 1, comprising the steps of compressing starting materials that comprise the base and the X-ray active layer in a pressing mold while simultaneously applying elevated temperature and a varying electric current, whereby a preselected shape exhibiting high strength diffusion bonds between the starting materials and a final density is provided.

34. The method according to claim 33, wherein the starting materials further comprise materials that provide an intermediate layer between the base and X-ray active layer, the intermediate layer functioning as a bonding layer and a diffusion barrier between the base layer and the X-ray active layer.

35. The method according to claim 33,wherein the starting materials further comprise materials to provide a base having multiple layers, the base including an intermediate layer comprising graphite, the starting materials further comprising an additive to at least one of the multiple layers of the base, the additive selected from oxides, nitrides, borides, carbides, silicides of tantalum, niobium, chromium, silicon, molybdenum, hafnium, boron and/or tungsten, or mixtures thereof, the additive being included in a stability-increasing and a heat conductivity improving amount.

36. The method according to claim 35, further comprised of the steps of machining the preselected shape.

37. The X-ray rotating anode plate according claim 1, wherein the base is provided with multiple layers and the proportion of carbon nanoparticles in the axial direction varies in each layer.

* * * * *